US006518473B2

(12) United States Patent
Miller et al.

(10) Patent No.: US 6,518,473 B2
(45) Date of Patent: Feb. 11, 2003

(54) DIMERIZING OLEFINS TO MAKE LUBE BASE STOCKS

(75) Inventors: Stephen J. Miller, San Francisco, CA (US); Russell R. Krug, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/758,670

(22) Filed: Jan. 11, 2001

(65) Prior Publication Data

US 2002/0128530 A1 Sep. 12, 2002

(51) Int. Cl.[7] ..... C07C 2/02

(52) U.S. Cl. ..... 585/517; 585/510; 585/518; 585/327; 585/324

(58) Field of Search ..... 585/517, 510, 585/518, 327, 324

(56) References Cited

U.S. PATENT DOCUMENTS

| | | | | |
|---|---|---|---|---|
| 3,852,207 | A | 12/1974 | Stangeland et al. | 208/58 |
| 3,904,513 | A | 9/1975 | Fischer et al. | 208/18 |
| 4,053,534 | A | 10/1977 | Mitchell et al. | 260/583 |
| 4,157,294 | A | 6/1979 | Iwao et al. | 208/264 |
| 4,401,556 | A | 8/1983 | Bezman et al. | 208/111 |
| 4,417,088 | A | 11/1983 | Miller | 585/530 |
| 4,482,752 | A | 11/1984 | Mitchell et al. | 585/670 |
| 4,513,156 | A | 4/1985 | Tabak | 585/324 |
| 4,523,045 | A | 6/1985 | Vora | 585/254 |
| 4,523,048 | A | 6/1985 | Vora | 585/323 |
| 4,551,438 | A | 11/1985 | Miller | 502/62 |
| 4,608,450 | A | 8/1986 | Miller | 585/517 |
| 4,657,661 | A | 4/1987 | Miller | 208/58 |
| 4,820,402 | A | 4/1989 | Partridge et al. | 208/111 |
| 4,913,799 | A | 4/1990 | Gortsema et al. | 208/89 |
| 5,012,021 | A | 4/1991 | Vora et al. | 585/315 |
| 5,059,567 | A | 10/1991 | Linsten et al. | 502/64 |
| 5,073,530 | A | 12/1991 | Bezman et al. | 502/65 |
| 5,082,986 | A | 1/1992 | Miller | 585/667 |
| 5,105,049 | A | 4/1992 | Hasselbring | 585/516 |
| 5,114,563 | A | 5/1992 | Lok et al. | 208/114 |
| 5,118,902 | A | 6/1992 | Drake | 585/516 |
| 5,135,638 | A | 8/1992 | Miller | 208/27 |
| 5,198,203 | A | 3/1993 | Kresge et al. | 423/718 |

(List continued on next page.)

OTHER PUBLICATIONS

Dornte, R. W., *Oxidation of White Oils, Industrial and Engineering Chemistry*, Industrial Edition, Jan., 1936, vol. 28, No. 1, Published by American Chemical Society, Easton, PA. pp. 26–30.

*Primary Examiner*—Thuan D. Dang
(74) *Attorney, Agent, or Firm*—Burns, Doane, Swecker & Mathis, L.L.P.

(57) ABSTRACT

Lube base stock compositions, and methods for preparing the compositions, are disclosed. The methods involve subjecting a predominantly $C_{5-11}$ olefin-containing feedstock to dimerization conditions, preferably using nickel ZSM-5 as the dimerization catalyst, to give a first product where the majority of the olefins in the olefinic feed are converted to hydrocarbons predominantly in the $C_{10-22}$ range. The first product, optionally combined with an olefin-containing feed in the $C_{10-22}$ range, preferably in the $C_{12-18}$ range, is subjected to an additional dimerization step, using the same or a similar dimerization catalyst, to provide a second product that includes hydrocarbons in the lube base stock range. The olefinic feedstock may include paraffins as well as olefins, which paraffins do not participate in the dimerization reactions. Accordingly, the second product includes relatively heavy hydrocarbons in the lube base stock range, as well as the relatively light unreacted paraffins (and any unreacted olefins). The hydrocarbons in the lube base stock range can be readily separated, for example, via distillation. In one embodiment, at least a portion of the olefin-containing feeds is derived, in whole or in part, from Fischer-Tropsch synthesis.

22 Claims, 1 Drawing Sheet

U.S. PATENT DOCUMENTS 5,198,597 A 3/1993 O'Young et al. ..... 585/654
5,246,566 A 9/1993 Miller ..... 208/27
5,246,689 A 9/1993 Beck et al. ..... 423/705
5,282,958 A 2/1994 Santilli et al. ..... 208/111
5,334,368 A 8/1994 Beck et al. ..... 423/704
5,413,695 A 5/1995 Miller ..... 208/28
5,502,018 A 3/1996 Chauvin et al. ..... 502/152
5,741,759 A 4/1998 Gee et al. ..... 507/103
5,866,746 A 2/1999 Didilliion et al. ..... 585/661
5,965,783 A 10/1999 Gee et al. ..... 585/664
6,004,256 A 12/1999 Townsend et al. ..... 508/503

DIMERIZING OLEFINS TO MAKE LUBE BASE STOCKS

FIELD OF THE INVENTION

The present invention is generally in the area of hydrocarbon synthesis, more particularly, the production of lube base stocks, preferably unconventional base oils, from Fischer-Tropsch or wax-derived olefins.

BACKGROUND OF THE INVENTION

Oxygenates such as methyl t-butyl ether (MTBE) and tertiary-amyl methyl ether (TAME) have been part of the United States gasoline strategy since the late 1970s. These ethers are typically produced by reacting branched C4 and C5 olefins, respectively with alcohols in a catalytic distillation unit. Environmental concerns will likely result in the phase-out of these additives. However, oil companies have expended a great deal of capital developing MTBE and TAME plants to produce these oxygenates, and will need to find new methods for using the plants once MTBE and TAME production is phased out.

Lube base stocks are made by a variety of methods, including subjecting waxy feedstocks to wax isomerization and/or solvent dewaxing, and oligomerizing 1-decene. Yields from wax isomerization and/or solvent dewaxing are relatively low, and costs are relatively high. 1-Decene is a relatively expensive feedstock for lube base stock production.

It would be desirable to have additional methods for forming lube base stocks. It would also be desirable to have methods for using MTBE and TAME plants for other purposes, such as the production of lube base stocks. The present invention provides such methods.

SUMMARY OF THE INVENTION

Lube base stock compositions, and methods for preparing the compositions, are disclosed. The methods involve subjecting a predominantly $C_{5-11}$ olefin-containing feedstock to dimerization conditions, preferably using nickel ZSM-5 as the dimerization catalyst, to give a first product where the majority of the olefins in the olefinic feed are converted to hydrocarbons predominantly in the $C_{10-22}$ range. The first product, optionally combined with an olefin-containing feed in the $C_{10-22}$ range, preferably in the $C_{12-18}$ range, is subjected to an additional dimerization step, using the same or a similar dimerization catalyst, to provide a second product that includes hydrocarbons in the lube base stock range. The olefinic feedstock may include paraffins as well as olefins, which paraffins do not participate in the dimerization reactions. Accordingly, the second product includes relatively heavy hydrocarbons in the lube base stock range, as well as relatively light unreacted paraffins (and any unreacted olefins). The hydrocarbons in the lube base stock range can be readily separated, for example, via distillation.

In one embodiment, at least a portion of the olefin-containing feeds is derived, in whole or in part, from Fischer-Tropsch synthesis. Fischer-Tropsch products in the $C_{5-11}$ range typically include about 30–60% by weight olefins when the synthesis is performed using a fixed or fluidized bed reactor.

The olefinic feeds may need to be pre-treated to avoid fouling various dimerization catalysts. If the feeds contain oxygenates such as alcohols and acids, the oxygenates can be removed, for example, by adsorption, extraction, dehydration and/or decarboxylation. Alternatively, they can be removed by hydrotreatment. However, hydrotreatment reduces olefins to paraffins, and the resulting paraffinic feed may need to be subjected to dehydrogenation conditions to form olefins. The dehydrogenation conditions tend to form diolefins, which can be removed via selective hydrogenation. The olefinic feed, the first product and/or the second product can be subjected to hydroisomerization conditions to control the pour and cloud points. The second product can be subjected to hydrofinishing conditions to hydrogenate any remaining olefins.

The second product is preferably separated from any unreacted paraffins in the olefinic feed, which do not participate in the dimerization reactions. These paraffins can be subjected to dehydrogenation conditions, and recycled through the dimerization steps.

Preferably, one or more of the dimerization steps are performed using a catalytic distillation unit or a fixed catalytic bed. More preferably, the method involves using the fixed bed in an MTBE or TAME plant to perform the first dimerization step, and/or the catalytic distillation unit from an MTBE or TAME plant to perform the second dimerization step and product isolation.

The resulting product includes hydrocarbons in the lube base stock range, which can optionally be further processed. The product can be combined with various additives to provide a finished lube composition. Preferably, the product includes sufficient branching to lower the pour and cloud points, but sufficient linear paraffinic character to maintain a relatively high viscosity index. More preferably, the product is an unconventional base oil. The viscosity indices of the unconventional base oils are much higher than those commonly used in the industry.

BRIEF DESCRIPTION OF THE DRAWING

The Figure represents a schematic illustration of one embodiment of the method of the present invention.

DETAILED DESCRIPTION OF THE PREFERRED EMBODIMENTS

Figure 1:
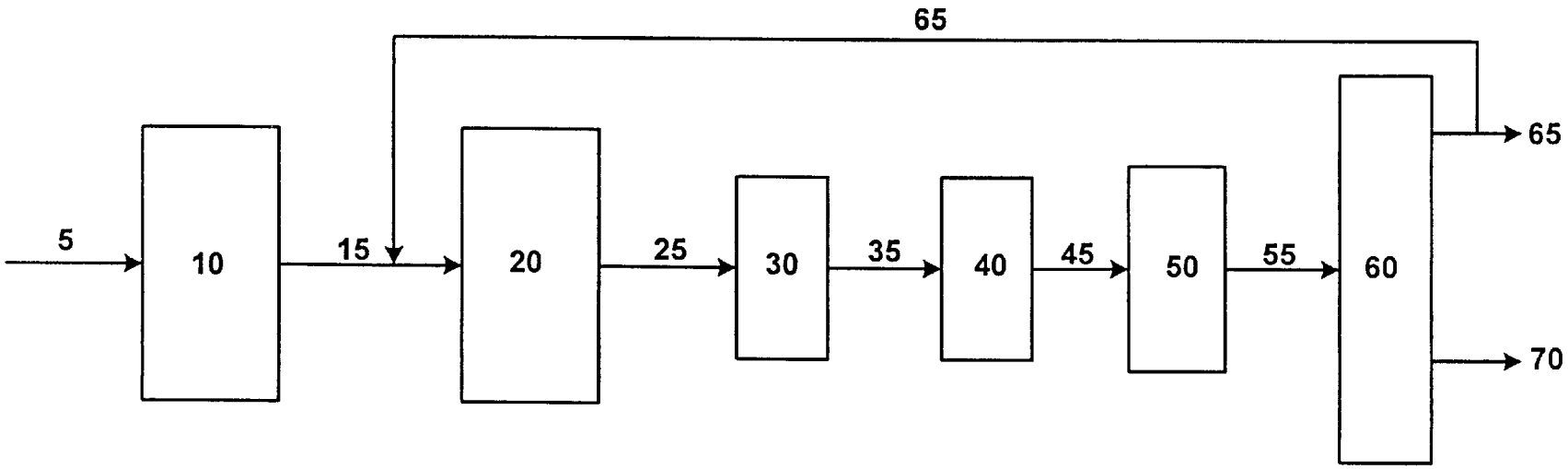

Lube base stock compositions, and methods for preparing the compositions, are disclosed. The methods involve subjecting a predominantly $C_{5-11}$ olefin-containing feedstock to dimerization conditions, preferably using an acidic catalyst such as Ni/ZSM-5 as the dimerization catalyst, to give a first product where the majority of the olefins in the olefinic feed are converted to hydrocarbons predominantly in the $C_{10-22}$ range. The first product, optionally combined with an olefin-containing feed in the $C_{10-22}$ range, preferably in the $C_{12-18}$ range, is subjected to an additional dimerization step, using the same or a similar dimerization catalyst, to provide a second product that includes hydrocarbons in the lube base stock range. The olefinic feedstock may include paraffins as well as olefins, which paraffins do not participate in the dimerization reactions. Accordingly, the second product includes relatively heavy hydrocarbons in the lube base stock range, as well as the relatively light unreacted paraffins (and any unreacted olefins). The hydrocarbons in the lube base stock range can be readily separated, for example, via distillation.

Definitions

As used herein the following terms have the following meanings unless expressly stated to the contrary:

The term "catalytic distillation unit" refers to a distillation unit having, within it, at least one bed of catalyst.

The term "dehydrogenation zone" refers to a reaction zone were paraffin dehydrogenation to form olefins is the predominate reaction, although in one embodiment, the dehydrogenation involves the hydrocracking of paraffinic wax to form olefins.

The term "relatively heavy hydrocarbons" refers to a heavier fraction of the product from the second dimerization reaction.

The term "highly paraffinic feedstock" refers to a feedstock comprising at least 50% paraffins.

The term "relatively light hydrocarbons" refers to a lighter fraction of the product from the second dimerization reaction, and contains mostly unreacted paraffins, as well as any unreacted olefins. (The light byproduct fraction is lighter than the heavy product fraction).

The term "light gas fraction" refers to the lightest fraction of the separation of Fischer-Tropsch product. This fraction is sometimes referred to in the literature as a "tail gas fraction."

The term "lube base stock range" refers to materials having initial boiling points of at least 572° F. (300° C.).

The term "lube base stock" refers to hydrocarbons in the lube base stock range that have acceptable viscosity index and viscosity for use in making finished lubes. Lube base stocks are mixed with additives to form finished lubes.

The term "predominantly $C_{5-11}$" or "naphtha" fraction refers to a product stream including at least 80% by weight of hydrocarbons in the $C_{5-11}$ range. A "predominantly $C_{12-18}$" or "diesel" fraction refers to a product stream including at least 80% by weight of hydrocarbons in the $C_{12-18}$ range. These fractions are preferably isolated from Fischer-Tropsch synthesis.

The term "olefinic feedstock" refers to a feedstock having at least some olefins.

The term "dimerization catalyst" refers to a catalyst that can promote dimerization.

The term "dimerization zone" refers to a reaction zone containing an dimerization catalyst.

The term "oxidation stability" refers to a test measuring resistance to oxidation by means of a Dornte-type oxygen absorption apparatus (R. W. Dornte "Oxidation of White Oils," *Industrial and Engineering Chemistry,* Vol. 28:26, 1936). Normally, the conditions are one atmosphere of pure oxygen at 340° F., and one reports the hours to absorption of 1000 milliliters of oxygen by 100 g. of oil. In the Oxidator BN test, 0.8 milliliters of catalyst is used per 100 grams of oil and an additive package is included in the oil. The catalyst is a mixture of soluble metal-naphthenates simulating the average metal analysis of used crankcase oil. The additive package is 80 millimoles of zinc bis-polypropylene phenyl dithio phosphate per 100 grams of oil. The Oxidator BN measures the response of a lubricating oil in a simulated application.

The term "skeletal isomerization" refers to changing the structure of a molecule such as to increase its degree of branching without changing its molecular weight.

The term "viscosity index" refers to the measurement defined by D 2270-93.

The term "wax fraction" refers to the heaviest fraction of the separation of Fischer-Tropsch product. That fraction is called a wax fraction because it usually contains a high degree of waxy material.

Unless otherwise specified, all percentages are in weight percent and all molecular weights are number average molecular weights.

Olefinic Feedstocks

Virtually any predominantly $C_{5-11}$ olefin-containing feedstock can be used in the first dimerization step. Such feedstocks can be derived, for example, by wax cracking or from various petroleum refinery streams. It is preferred that such feedstocks do not include an appreciable amount of oxygenates and/or other impurities that adversely affect the dimerization catalyst. An "appreciable amount" depends on the sensitive of the particular catalyst used.

The olefinic feeds may need to be pre-treated to avoid fouling various dimerization catalysts. If the feeds contain oxygenates such as alcohols and acids, the oxygenates can be removed, for example, by adsorption, extraction, dehydration and/or decarboxylation. Alternatively, they can be removed by hydrotreatment. However, hydrotreatment reduces olefins to paraffins, and the resulting paraffinic feed may need to be subjected to dehydrogenation conditions to form olefins. The dehydrogenation conditions tend to form diolefins, which can be removed via selective hydrogenation.

Fischer-Tropsch Synthesis

In one embodiment, at least a portion of the olefin-containing feeds is derived, in whole or in part, from Fischer-Tropsch synthesis. Fischer-Tropsch products in the $C_{5-11}$ range typically include about 30–60% by weight olefins when the synthesis is performed using a fixed bed or fluidized bed reactor, with the fluidized bed reactor generally producing the highest olefinicity.

The Fischer-Tropsch products can be separated into at least a light gas fraction, a predominantly $C_{5-11}$ (naphtha) fraction, a predominantly $C_{12-18}$ (diesel) fraction, and a wax fraction. The naphtha fraction is preferably used for the olefinic feedstock for the first dimerization reaction. The diesel fraction can be combined with the product of the first dimerization reaction and subjected to the second dimerization reaction. The wax fraction alone or the combination of the wax fraction and a portion of the diesel fraction can be thermally cracked and at least a portion of that cracked product can be sent to the first and/or second dimerization zone, depending on the molecular weight range of the cracked product.

Fischer-Tropsch Chemistry

Fischer-Tropsch synthesis may be effected in a fixed bed, in a slurry bed, or in a fluidized bed reactor. The Fischer-Tropsch reaction conditions may include using a reaction temperature of between 190° C. and 340° C., with the actual reaction temperature being largely determined by the reactor configuration. Thus, when a fluidized bed reactor is used, the reaction temperature is preferably between 300° C. and 340° C.; when a fixed bed reactor is used, the reaction temperature is preferably between 200° C. and 250° C.; and when a slurry bed reactor is used, the reaction temperature is preferably between 190° C. and 270° C.

An inlet synthesis gas pressure to the Fischer-Tropsch reactor of between 1 and 50 bar, preferably between 15 and 50 bar, may be used. The synthesis gas may have a $H_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferred promoters are those influencing the surface area of the reduced iron ("structural promoters"), and these include oxides or metals of Mn, Ti, Mg, Cr, Ca, Si, Al, or Cu or combinations thereof.

The Separation of Product From the Fischer-Tropsch Reaction

The products from Fischer-Tropsch reactions performed in fluidized bed reactors generally include a gaseous reaction product and a liquid reaction product. The gaseous reaction product includes hydrocarbons boiling below about 650° F. (e.g., tail gases through middle distillates). The liquid reaction product (the wax fraction) includes hydrocarbons boiling above about 650° F. (e.g., vacuum gas oil through heavy paraffins).

The minus 650° F. product can be separated into a light gas fraction, a naphtha fraction and a diesel fraction, using, for example, a high pressure and/or lower temperature vapor-liquid separator or low pressure separators or a combination of separators. The fraction boiling above about 650° F. (the wax fraction) primarily contains $C_{20}$ to $C_{50}$ linear hydrocarbons (paraffins, olefins and alcohols) with relatively small amounts of higher boiling branched hydrocarbons.

Optional Fischer-Tropsch Process Steps

The presence of sulfur, nitrogen, halogen, selenium, phosphorus, and arsenic contaminants in the feedstock is undesirable. For this reason, it is preferred to remove sulfur and other contaminants from the feed before performing the dehydrogenation and dimerization steps. Means for removing these contaminants are well known to those of skill in the art. For example, hydrotreating and adsorption on ZnO guardbeds are preferred for removing sulfur impurities. Preferably, the sulfur content is reduced below 100 ppm, most preferably below 50 ppm. Nitrogen can be removed by hydrotreating. The product nitrogen content should be below 50 ppm, preferably below 10 ppm. Means for removing other contaminants are well known to those of skill in the art.

Purification of the Olefinic Feedstock

Preferably, the olefinic feedstock is purified in a purification zone (e.g., hydrotreated in a hydrotreating zone) to remove oxygenates and other impurities. Such hydrotreating zones are well known in the industry. Other treatments useful for removing oxygen and other impurities include, but are not limited to, adsorption (e.g., with an acid clay), and extraction.

Preferably, the olefinic feedstock is also dehydrated and decarboxylated to convert alcohols or acids which may be present to olefins. Both reactions can be effected by processing the feedstock over a catalyst, typically alumina, under moderate temperatures and pressures. The reaction of linear alcohols yields predominantly linear olefins and, and acids yield paraffins and carbon dioxide. The water and carbon dioxide can be removed from the reaction mixture, for example, by distillation.

Purification of the Olefinic Feedstock By Hydrotreatment

Hydrogenation catalysts can be used for the purification. For example, a noble metal from Group VIIIA according to the 1975, rules of the International Union of Pure and Applied Chemistry, such as platinum or palladium on an alumina or siliceous matrix, or unsulfided Group VIIIA and Group VIB, such as nickel-molybdenum or nickel-tin on an alumina or siliceous matrix, is a suitable catalyst. U.S. Pat. No. 3,852,207 to Stangeland et al. ("Production of Stable Lubricating Oils By Sequential Hydrocracking and Hydrogenation") describes a suitable noble metal catalyst and mild conditions. Other suitable catalysts are detailed, for example, in U.S. Pat. No. 4,157,294 to Iwao, et al. ("Method of Preparing Base Stocks For Lubricating Oil"), and U.S. Pat. No. 3,904,513 to Fischer et al. ("Hydrofinishing or Petroleum"). The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not the case. They are usually added as a metal salt, which can be thermally converted to the corresponding oxide in an oxidizing atmosphere or reduced to the metal with hydrogen or other reducing agent. If necessary, the non-noble metal composition can then be sulfided by reaction with a sulfur donor such as carbon bisulfide, hydrogen sulfide, hydrocarbon thiols, elemental sulfur, and the like.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica: alumina ratio zeolite Y such as for example described in U.S. Pat. No. 4,401,556 to Bezman, et al. ("Midbarrel Hydrocracking"), U.S. Pat. No. 4,820,402 to Partridge, et al., ("Hydrocracking Process With Improved Distillate Selectivity With High Silica Large Pore Zeolites"), and U.S. Pat. No. 5,059,567 to Linsten, et al. ("Process For The Preparation of A Modified Zeolite"). Small crystal size zeolite Y, such as described in U.S. Pat. No. 5,073,530 to Bezman, et al. ("Hydrocracking Catalyst And Process") can also be used. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 to Gortsema, et al. ("Hydrocracking Catalysts And Processes Employing Non-Zeolitic Molecular Sieves") and the references cited therein. Details regarding the preparation of various non-zeolite molecular sieves can be found in U.S. Pat. No. 5,114,563 to Lok, et al. ("Hydrocarbon Conversions Using Catalysts Silicoaluminophosphates"); and in U.S. Pat. No. 4,913,799. Mesoporous molecular sieves can also be included, for example the M41S family of materials, MCM-41 (U.S. Pat. No. 5,246,689 to Beck, et al. ("Synthetic Porous Crystalline Material Its Synthesis And Use"), U.S. Pat. No. 5,198,203 to Kresge, et al. ("Synthetic Mesoporous Crystalline Material"), and U.S. Pat. No. 5,334,368 to Beck, et al. ("Synthesis of Mesoporous Oxide")), and MCM-48.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment, or chemical modification.

Furthermore more than one catalyst type may be used in the reactor. The different catalyst types can be separated into layers or mixed.

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

If it is desirable to introduce skeletal isomerization during the hydrotreating step, or during the hydrotreating of the product from the dimerization reactor, or during the hydrotreating of the final lube base stock range hydrocarbons, the matrix of the catalyst is chosen to facilitate this reaction. Detailed descriptions of catalysts that do this reaction are shown in U.S. Pat. Nos. 5,282,958; 5,246,566; 5,135,638 and 5,082,986, the contents of which are hereby incorporated by reference for all purposes. A molecular sieve is used as one component in the matrix. The sieve has pores of less than 7.1Å, preferably less than 6.5Å; and having at least one pore diameter greater than 4.8Å, and having a crystal size no more than about 0.5 microns. The catalyst is further characterized in that it has sufficient acidity to convert at least 50% of hexadecane at 370° C., and exhibits a 40 or greater isomerization selectivity ratio as defined in U.S. Pat. No. 5,282,958 at 96% hexadecane conversion. Specific examples of molecular sieves which satisfy these requirements are ZSM-12, ZSM-21, ZSM-22, ZSM-23, ZSM-35, ZSM-38, ZSM-48, ZSM-57, SSZ-32, SSZ-35, Ferrierite, L-type zeolite, SAPO-11, SAPO-31, SAPO-41, MAPO-11 and MAPO-31.

U.S. Pat. Nos. 3,852,207; 3,904,513; 4,157,294; 4,401,556; 4,820,402; 4,913,799; 5,059,567; 5,073,530; 5,114,563; 5,198,203; 5,246,689; and 5,334,368 are hereby incorporated by reference for all purposes.

Purification of the Feedstock By Adsorption

An adsorption step may be employed to remove nitrogenous species from the feed. It is preferred that the concentration of organic nitrogen in the feed to the oligomerization step in the present process be less than about 40 ppm, preferably less than about 20 ppm. Suitable adsorbents to remove the nitrogen compounds include heterogeneous acid materials such as acidic clays, molecular sieves, and ion exchange resins. Such materials are described in U.S. Pat. No. 4,657,661 to Miller ("Process For Improving The Storage Stability And Bulk Oxidation Stability Of Lube Base Stocks Derived From Bright Stock"), hereby incorporated by reference for all purposes.

Paraffin Dehydrogenation

If the olefinic feedstock is hydrotreated to remove impurities, and such hydrotreatment significantly lowers the olefin content, the feedstock can be subjected to dehydrogenation conditions to form additional olefins. Unreacted paraffins from the second dimerization zone can also be subjected to dehydrogenation conditions to form an additional olefinic feedstock, which can be recycled.

Dehydrogenation processes known in the art generally have employed catalysts which comprise a noble metal, usually Pt, supported on a non-acid support, typically alumina, silica, or non-acidic alumino silicate. The temperature at which paraffin dehydrogenation is normally carried out is in a range from 350° to 650° C. (preferably from 400° to 550° C.). The process is usually carried out at atmospheric pressure, although it is possible to operate at a pressure of several atmospheres, for example up to 10 atmospheres.

The linear paraffins are generally fed at a rate of from 0.001 to 100 volumes (calculated as a liquid) per hour for each volume of catalyst. Moreover, since the dehydrogenation reaction takes place in the presence of hydrogen gas, it is convenient to maintain the molar ratio of hydrogen to linear paraffin in the feed mixture at a value of from 1:1 to 50:1.

Skeletal isomerization can be carried out simultaneously with dehydrogenation by using a catalyst with an acidic isomerization function in combination with a catalyst with a dehydrogenation function. These catalytic functions can be on separate particles with the particles either mixed or in layers, or on the same particle. Examples of catalysts which carry out both isomerization and dehydrogenation include Group VIII metals on acidic amorphous supports, such as taught in U.S. Pat. No. 5,866,746 to Didillion, et al. ("Catalytic Dehydroisomerization of $C_4$–$C_5$ N-Paraffins"), and metals on zeolitic supports, such as taught in U.S. Pat. No. 5,198,597 to O'Young, et al. ("Bimetallic Catalysts For Dehydroisomerization of N-Butane to Isobutene").

In order to reduce or eliminate the amount of diolefins produced or other undesired byproducts the reaction conversion to olefins in the olefinic feedstock should preferably not exceed 50% and more preferably should not exceed 30% based on the linear hydrocarbon content of the feed. Preferably, the minimum conversion is at least 10% and more preferably at least 20%.

If skeletal isomerization is not induced during hydrotreatment of the feedstock or during dehydrogenation, these olefins inherently are usually predominately internal olefins.

Skeletal Isomerization

Skeletal isomerization of the paraffinic feedstock, the olefinic feedstock, the first product (from the first dimerization zone), the second product (from the second dimerization zone) or of the heavy fraction can be used to control the pour and cloud point of the final product to the desired value. Preferably, this skeletal isomerization is induced prior to the first dimerization zone.

Skeletal isomerization is preferred before dimerization because, if isomerization is required to meet pour point requirements, the yield loss in isomerizing the lower molecular weight components to the dimerization step will be less than in isomerizing the high molecular weight dimer to the same pour point. This will result in a higher yield of lube base stock, since the cracking and yield loss trying to isomerize the dimer can thus be avoided.

If it is desired to induce skeletal isomerization of the olefinic intermediates (either the product from the paraffin dehydrogenation step, or the first dimerization step), U.S. Pat. No. 5,741,759 to Gee, et al. ("Skeletally Isomerized Linear Olefins") and U.S. Pat. No. 5,965,783 to Gee, et al. ("Process For Isomerizing Olefins"), the contents of which are hereby incorporated by reference for all purposes, describe catalysts and process conditions to do this. Molecular sieves as defined above in the paraffin skeletal isomerization step may be used as catalyst, however metals, such as noble metals, are excluded from the catalyst formulation. The molecular sieve is frequently composited with a binder to form an extrudate, sphere, or pellet. Temperatures used to skeletally isomerize the olefins are typically between 100 and 400° C., the WHSV is between 0.2 and 10, and the pressure is typically below 500 psig, preferably below 100 psig.

Selective Hydrogenation of Diolefins

Preferably, diolefins produced during the dehydrogenation step are removed by known adsorption processes or selective hydrogenation processes that selectively hydrogenate diolefins to monoolefins without significantly hydrogenating monoolefins. Suitable selective hydrogenation processes for hydrotreating diolefins to monoolefins without significantly hydrogenating monoolefins are, for example, described in U.S. Pat. No. 4,523,045 to Vora, U.S. Pat. No. 4,523,048 to Vora, and U.S. Pat. No. 5,012,021 to Vora, et al. If desired, branched hydrocarbons may be removed before or after the dehydrogenation process, typically by adsorption. U.S. Pat. Nos. 4,523,045; 4,523,048; 5,012,021; 5,198,597; 5,741,759; 5,866,746; and 5,965,783 are hereby incorporated by reference for all purposes.

The Dimerization Reaction

The olefinic feedstock produced in the dehydrogenation zone is contacted with a dimerization catalyst in a first dimerization zone. The first dimerization zone is preferably a fixed bed reactor, such as that found in an MTBE or TAME plant. Since the dimerization catalyst can also promote skeletal isomerization of olefins, both dimerization and skeletal isomerization can occur in the same process step.

Conditions for this reaction in the dimerization zone are between room temperature and 400° F., preferably between 90 and 275° F., from 0.1 to 3 LHSV, and from 0 to 500 psig, preferably between 50 and 150 psig. Catalysts for dimerization can be virtually any acidic material including zeolites, clays, resins, $BF_3$ complexes, HF, $H_2SO_4$, $AlCl_3$, ionic liquids (preferably acidic ionic liquids), superacids, etc. Preferably, the catalyst is a Group VIII metal on an inorganic oxide support, more preferably a Group VIII metal on a zeolite support. Zeolites are preferred because of their resistance to fouling and ease of regeneration. In one embodiment, the catalyst is nickel on ZSM-5. Catalysts and conditions for the dimerization of olefins are well known, and are disclosed, for example, in U.S. Pat. Nos. 4,053,534; 4,482,752; 5,105,049 and 5,118,902, the disclosures of which are incorporated herein by reference for all purposes.

The product of the first dimerization step, optionally combined with an olefinic feedstock in the diesel range, is subjected to a second dimerization step in a second dimerization zone to form a second product. In one embodiment, the second dimerization zone is located within a catalytic distillation unit used to both produce the second product and separate the second product into a relatively light fraction and a relatively heavy fraction. This embodiment can be used to take advantage of refinery capacity made surplus by prohibitions against TAME and MTBE in gasoline.

Preferably, portions of the relatively light fraction and the relatively heavy fraction are refluxed to the catalytic distillation unit. The olefinic feedstock can be contacted with a dimerization catalyst within the catalytic distillation unit or within a fixed bed.

If desired, skeletal isomerization can be induced on the product from either the first or second dimerization zones, using a matrix of the catalyst chosen to facilitate this reaction, as described above in the "Purification of the Feedstock By Hydrotreatment" section.

Olefins from Other Sources

The present invention involves not only the process where one dehydrogenates a highly paraffinic feedstock to produce an olefinic feedstock, then contacts that olefinic feedstock with a dimerization catalyst in a dimerization zone. It also involves the process (and hydrocarbons in the lube base stock range produced by that process) where one contacts an olefinic feedstock obtained from an alternative source with an dimerization catalyst. By "alternative source," we mean that not all of the olefinic feedstock is made in a dehydrogenation zone within the same plant as the dimerization zone. One possible "alternative source" is an olefinic feedstock obtained from another company, wherein that olefinic feedstock was produced by dehydrogenating a highly paraffinic $C_{5-11}$ feedstock in a dehydrogenation zone. Another possible "alternative source" is a mixture of (1) an olefinic feedstock produced by dehydrogenating a highly paraffinic $C_{5-11}$ feedstock in a dehydrogenation zone (in the same or different plant as the dimerization unit), (2) an olefinic feedstock produced by hydrocracking a waxy hydrocarbon feed, preferably derived in whole or in part from Fischer-Tropsch wax, and (3) an olefinic feedstock produced by any other method.

The Separation of the Product of the Second Dimerization Zone

The product of the second dimerization zone is separated into a light fraction and a heavy fraction, wherein the heavy fraction comprises a lube base stock. This separation can be done by conventional separation techniques, such as distillation.

The heavy product fraction includes predominately hydrocarbons in the lube base stock range that have acceptable viscosity index and viscosity for use in making finished lubes (lube base stock). Preferably, the heavy fraction has a viscosity of greater than 2 cSt at 100° C. and a viscosity index of above 80 (more preferably above 95, still more preferably above 120). A viscosity index of over 120 is preferred over a viscosity of over 80 because the higher VI oil will maintain its viscosity to a greater degree over a range of temperatures (the definition of VI). The higher VI oil will likely have higher oxidation stability. Preferably, the pour point is less than −10° C., more preferably less than −20° C.

If desired, skeletal isomerization can be induced on the heavy product fraction, using a matrix of the catalyst chosen to facilitate this reaction, as described above in the "Purification of the Feedstock By Hydrotreatment" section.

Preferably, at least a portion of the light fraction is recycled to the dehydrogenation zone. Alternatively, it can be recycled to the purification zone or to one or both of the dimerization zones, depending on the molecular weight range of the light fraction.

Distillation bottoms can be discarded (e.g., if any solids are present), or they can be kept for subsequent processing.

Preferably, the heavy fraction is separated into at least one of the following fractions:

a) a) a light lube base stock fraction having a viscosity of from 2 to 7 cSt at 100° C.;

b) a heavy lube base stock fraction having a viscosity of from 6 to 20 cSt at 100° C.; and c) a bright stock fraction having a viscosity of greater than 180 cSt at 40° C.

The specifications for lube base stocks are defined in the API Interchange Guidelines (API Publication 1509). Group II base stocks have no more than 300 ppm sulfur, have at least 90% saturates, and have viscosity indexes of from 80 to less than 120. Group II base stock constitutes about 10% of the world lube base stock production, and approximately 30% of the U.S. production.

For Group II stocks, preferably the heavy product fraction is separated into at least one of the following fractions:

a) a light lube base stock fraction having a viscosity of from 3 to 6 cSt at 100° C., more preferably from 3.5 to 5 cSt, most preferably from 3.8 to 4.2 cSt;

b) a heavy lube base stock fraction having a viscosity of from 6 to 16 cSt at 100° C., more preferably from 9 to 13 cSt, most preferably from 11 to 12.5 cSt; and c) a bright stock fraction having a viscosity of greater than 180 cSt at 40° C., more preferably greater than 220, most preferably greater than 250 cSt.

Group III base stocks have no more than 300 ppm sulfur, have at least 90% saturates, and have viscosity indexes of 120 or more. Only a small fraction of the lube base stock production in the world is Group III base stock. For these Group III stocks, preferably the heavy product fraction is separated into at least one of the following fractions:

a) a light lube base stock fraction having a viscosity of from 3 to 7 cSt at 100° C., more preferably from 4 to 6 cSt, most preferably from 4.7 to 5.3 cSt;

b) a heavy lube base stock fraction having a viscosity of from 7 to 20 cSt at 100° C., more preferably from 10 to 15 cSt, most preferably from 12 to 13.5 cSt; and c) a bright stock fraction having a viscosity of greater than 180 cSt at 40° C., more preferably greater than 220, most preferably greater than 250 cSt.

The split between the light fraction and the heavy fraction can be adjusted, along with the amount of recycle, to control the viscosity grade distribution of lubes products made. In one particularly preferred embodiment, the separation of fractions is adjusted so that the heavy fraction is mainly a bright stock fraction. Substantially the entire light fraction can be recycled to the dehydrogenation zone and/or to one or both of the dimerization zones.

Undesired buildup in any of the recycle streams can be managed by taking a bleed from the recycle stream and either using it as fuel oil or blending it into export crude.

Hydrofinishing of the Heavy Fraction

Preferably, either the product of the second dimerization zone or the heavy fraction is hydrofinished to eliminate any remaining olefins. More preferably, the heavy fraction is hydrogenated to remove any remaining olefins. Typical conditions are between 200 and 600° F., 0.1 to 10 LHSV, and 200 to 3000 psig. Catalysts useful for this reaction include any NiMo supported catalyst or a Group VIII metal on a support. Preferred catalysts are platinum, palladium, or platinum-palladium alloys.

If the product of the dimerization is hydrofinished, then at least a portion of the light byproduct fraction preferably goes to the dehydrogenation zone, the purification zone, or to fuel. If the heavy fraction is hydrogenated, at least a portion of the light fraction preferably goes to the dehydrogenation zone, the first purification zone, one or both of the dimerization zones, or to fuel.

Conventional cloud point reduction processes can be used to correct any unacceptable cloud point. For instance, this can be done either before hydrofinishing in a separate reactor, by isomerizing the olefinic dimer (e.g., see U.S. Pat. Nos. 5,082,986 and 5,965,783) or in the same reactor with the hydrofinishing catalyst.

Hydrocracking

In one embodiment of the present invention, the wax fraction from the Fischer-Tropsch synthesis is hydrocracked, followed preferably by dehydrogenation, to provide a predominantly $C_{5-11}$ and/or $C_{10-22}$ olefinic feedstock. Hydrocracking can be effected by contacting the particular fraction or combination of fractions, with hydrogen in the presence of a suitable hydrocracking catalyst at temperatures in the range of about from 600° to 900° F. (316° to 482° C.) preferably 650° to 850 °F. (343° to 454° C.) and pressures in the range about from 200 to 4000 psia (13 to 272 atmospheres) preferably 500 to 3000 psia (34 to 204 atmospheres) using space velocities base on the hydrocarbon feedstock of about 0.1 to 10 $hr^{-1}$ preferably 0.25 to 5 $hr^{-1}$. Generally, more severe conditions within these ranges will be used with higher boiling feedstocks and depending on whether gasoline, middle distillate, or lubricating oil is desired as the primary economic product. The hydrocracking step reduces the size of the hydrocarbon molecules, hydrogenates olefin bonds, hydrogenates aromatics, and removes traces of heteroatoms resulting in an improvement in fuel or base oil product quality.

As is well known, the hydrocracking catalysts contain a hydrogenation component and a cracking component. The hydrogenation component is typically a metal or combination of metals selected from Group VIII noble and non-noble metals and Group VIB metals. The noble metals, particularly platinum or palladium, are generally more active but are expensive. Non-noble metals which can be used include molybdenum, tungsten, nickel, cobalt, etc. Where non-noble metals are used it is generally preferred to use a combination of metals, typically at least one Group VIII metal and one Group VIB metal, e.g., nickel-molybdenum, cobalt-molybdenum, nickel-tungsten, and cobalt-tungsten. The non-noble metal hydrogenation metal are usually present in the final catalyst composition as oxides, or more preferably, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The sulfide form of these metals is most preferred due to higher activity, selectivity and activity retention.

The hydrogenation components can be incorporated into the overall catalyst composition by any one of numerous procedures. They can be added either to the cracking component or the support or a combination of both. In the alternative, the Group VIII components can be added to the cracking component or matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst support as the sulfides, that is generally not the case. They are usually added as a metal salt, which can be thermally converted to the corresponding oxide in an oxidizing atmosphere or reduced to the metal with hydrogen or other reducing agent. The non-noble metal composition can then be sulfided by reaction with a sulfur donor such as carbon bisulfide, hydrogen sulfide, hydrocarbon thiols, elemental sulfur, and the like.

The cracking component is an acid catalyst material and may be a material such as amorphous silica-alumina or may be a zeolitic or non-zeolitic crystalline molecular sieve. Examples of suitable hydrocracking molecular sieves include zeolite Y, zeolite X and the so called ultra stable zeolite Y and high structural silica:alumina ratio zeolite Y. Non-zeolitic molecular sieves which can be used include, for example silicoaluminophosphates (SAPO), ferroaluminophosphate, titanium aluminophosphate and the various ELAPO molecular sieves. Mesoporous molecular sieves can also be included. These materials are described above in the section "Purification of the Feedstock By Hydrotreatment."

In general amorphous silica-alumina is more selective for middle distillates, e.g., diesel fuel, whereas crystalline molecular sieves are much more active and produce greater amounts of lighter products, e.g., naphtha. The so-called high (structural) silica-alumina ratio ($Si_2O_3$:$Al_2O_3$=about 50) Y zeolites are less active than the conventional zeolite Y but, are more selective for middle distillate and more active than amorphous silica-alumina. The catalyst also typically contains a matrix or binder material resistant to the conditions used in the hydrocracking reaction. Suitable matrix materials include synthetic or natural substances as well as inorganic materials such as clay, silica and/or metal oxides. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment or chemical modification.

The catalyst may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The relative proportions of molecular sieve component and inorganic oxide matrix or binder may vary widely with the molecular sieve content ranging from between 1 to 99, more usually 5 to 80, percent by weight of the composite. The matrix may itself possess catalytic properties generally of an acidic nature, such as for example where amorphous silica-alumina is used as a matrix or binder for a molecular sieve. In general we prefer to use a non-zeolite or low acidic zeolite catalyst, e.g., high structural silica:alumina ratio Y zeolite, as the catalyst where middle distillates is desired as the main commercial product and an acidic zeolite catalyst, e.g., conventional or ultra stabilized Y zeolite, where naphtha is desired as the main commercial product. More than one catalyst type may be used in the reactor. The different catalyst types can be separated into layers or mixed.

Additive Packages

The lube base stocks can be combined with various performance additives to form a lubricating composition. The term "performance additive package" as used in this specification and appended claims means any combination of other conventional additives for lubricating compositions. Such additives include corrosion and rust inhibitors, anti-oxidants, dispersants, detergents, anti-foam agents, anti-wear agents, friction modifiers and flow improvers. Such additives are described in "Lubricants and Related Products" by Dieter Klamann, Verlag Chemie, Deerfield Beach, Fla., 1984.

EXAMPLES

The invention will be further illustrated by following examples, which set forth particularly advantageous method embodiments. While the Examples are provided to illustrate the present invention, they are not intended to limit it.

Example One

Catalyst Screening for Olefin Dimerization Using 1-Decene

A series of catalysts were evaluated for olefin dimerization using stirred batch reactors with 1-decene as the test olefin. SAPO-11 was prepared according to patent literature. Acid clays were samples obtained from the commercial manufacturer. The pillared clays were made by pillaring montmorillonite clays with aluminum chlorhydrol solutions according to literature procedures. ETS-10 was prepared according to patent and literature examples and was ammonium-exchanged and calcined. It was an essentially non-acidic material. Al-MCM-41 was prepared according to Mobil patent examples. The $SiO_2/Al_2O_3$ was made by spray drying a co-gelled mixture made from $SiO_2$ and $Al_2O_3$ precursor compounds.

Catalysts were weighed into the reactor, which was then sealed. After drying the catalyst at 150° C. for 18 hours, 1-decene feed was added by syringe under a flow of dry nitrogen. The contents of the reactor were then stirred magnetically and heated to 150° C. The ratio of 1-decene feed to catalyst and the reaction times are given in Table 1. After the desired reaction time, the reactors were cooled and the products analyzed by gas chromatography. For each test, mole % decene conversion and dimer selectivity are shown. Dimer selectivity is defined as:

$$100 \times \text{Weight Dimer Formed/Weight 1-Decene Reacted}$$

The results show that a number of acidic oxide materials give moderate to high olefin dimerization selectivity. The other products formed are decene isomers. It is understood that results will be somewhat different when carried out at different olefin/catalyst ration, different reaction temperatures, and different reaction times. It is also understood that results obtained in a fixed bed constant flow system may be different that those obtained in batch reactions with the same catalyst. Nonetheless, these batch reaction results can suggest catalysts that will be effective in forming olefin dimers.

TABLE 1

| Catalyst | Catalyst Description | Reaction Time, hrs | Olefin/Cat Ratio g/g | Olefin Conv.,mole % | Diamization Selectivity, % | Pore Size |
|---|---|---|---|---|---|---|
| SAPO-11 | Silicoaluminophosphate | 19 | 1.5 | 96.0 | 42.1 | 10 MR (intermediate) |
| SAPO-11 | Silicoaluminophosphate | 1 | 1.5 | 97.6 | 26.8 | 10 MR (int.) |
| SAPO-11 | Silicoaluminohosphate | 4 | 1.5 | 83.1 | 28.3 | 10 MR (int.) |
| SAPO-11 | Silicoaluminophosphate | 8 | 1.5 | 83.6 | 39.7 | 10 MR (int.) |
| SAPO-11 | Silicoaluminophosphate | 12 | 1.5 | 85.2 | 37.2 | 10 MR (int.) |
| SAPO-11 | Silicoaluminophosphate | 3 | 1.5 | 82.2 | 38.8 | 10 MR (int.) |
| Acid Clay | Süd Chemie Tonsil COG | 24 | 3.0 | 92.7 | 58.5 | unknown |
| Acid Clay | Süd Chemie Tonsil CO614G | 24 | 3.0 | 97.0 | 58.3 | unknown |
| Acid Clay | Harshaw F24 | 24 | 3.0 | 99.3 | 40.5 | unknown |

TABLE 1-continued

| Catalyst | Catalyst Description | Reaction Time, hrs | Olefin/Cat Ratio g/g | Olefin Conv.,mole % | Diamization Selectivity, % | Pore Size |
|---|---|---|---|---|---|---|
| Pillared Clay | alumina pillared acid-leached Volclay montmorillonite clay | 24 | 3.0 | 98.5 | 64.5 | unknown |
| Pillared Clay | alumina pillared acid-leached Southern Clay Products montmorillonite clay | 24 | 3.0 | 99.3 | 61.3 | unknown |
| ETS-10 | Engelhard Titanosilicate | 22 | 3.0 | 2.4 | 56.8 | 12 MR |
| Al-MCM-41 | Mesoporous Aluminosilicate | 24 | 25.2 | 74.8 | 55.8 | Ultra Large Pore, 25 Anst. |
| MCM-22 | Aluminosilicate | 24 | 25.2 | 79.1 | 61.1 | 10 MR, 12 MR |
| $SiO_2/Al_2O_3$ | Cogel | 22 | 3.0 | 76.7 | 50.0 | Ultra Large Pore, mesoporous |

int. = intermediate

The non-acidic ETS-10 showed low conversion, indicating the importance of acid components in the catalyst.

Examples of Specific Embodiments

In one specific embodiment, as shown in the Figure, a highly paraffinic feedstock 5, predominantly in the $C_{5-11}$ range, and a paraffin content of at least 75%, is produced by a Fischer-Tropsch reaction. The highly paraffinic feedstock 5 is purified in a purification zone 10 to remove oxygenates and other impurities to form a purified paraffinic feedstock 15. The purified highly paraffinic feedstock 15 is dehydrogenated in a dehydrogenation zone 20 to produce an olefinic feedstock 25 having from 10% to 50% olefins. The olefinic feedstock 25 is contacted with a dimerization catalyst in a dimerization zone 30 to produce a first product 35. The first product 35 is subjected to a second dimerization step in a second dimerization zone 40 to produce a second product 45 which is then hydrofinished in a product hydrofinishing zone 50 to produce a hydrofinished product 55. The hydrofinished product 55 is separated in a product separator 60 into a light fraction 65 and a heavy fraction 70. That heavy product fraction 70 is a lube base stock having a viscosity of greater than 4 cSt at 100° C. and a viscosity index of above 80. At least a portion of the light fraction 65 is recycled to the dehydrogenation zone 20.

While the present invention has been described with reference to specific embodiments, this application is intended to cover those various changes and substitutions that may be made by those skilled in the art without departing from the spirit and scope of the appended claims.

What is claimed is:

1. A process for making a lube base stock comprising:

a) subjecting a $C_{5-11}$ olefin-containing feedstock that also comprises paraffins to a first dimerization reaction in the presence of a dimerization catalyst in a first dimerization zone to produce a first dimerization product, wherein said paraffins do not participate in the dimerization reaction;

b) subjecting the first dimerization product including unreacted paraffins to a second dimerization reaction in the presence of a dimerization catalyst in a second dimerization zone to produce a second dimerization product including said unreacted paraffins; and c) separating the second dimerization product into a light fraction and a heavy fraction including predominantly hydrocarbons in the lube base stock range.

2. The process of claim 1, wherein the olefinic feedstock has a paraffin content of at least 75% weight percent.

3. The process of claim 1, wherein the olefinic feedstock is produced, in whole or in part, by a Fischer-Tropsch process.

4. The process of claim 3, wherein the product of said Fischer-Tropsch process is separated into a light gas fraction, a naphtha fraction, a diesel fraction and a wax fraction, and wherein said naphtha fraction forms at least part of the olefinic feedstock.

5. The process of claim 1, wherein the olefinic feedstock is purified to remove oxygenates and other impurities selected from the group consisting of sulfur, nitrogen, halogen, selenium, phosphorus, and arsenic.

6. The process of claim 5, wherein the olefinic feedstock is purified by hydrotreatment, wherein skeletal isomerization is induced while the feedstock is being hydrotreated.

7. The process of claim 1, wherein said olefinic feedstock includes between 10% and 50% olefins by weight.

8. The process of claim 1, wherein skeletal isomerization is induced on the olefinic feedstock before it is subjected to the first or second dimerization zone.

9. The process of claim 1, wherein the dimerization catalyst comprises an inorganic oxide support.

10. The process of claim 9, wherein the dimerization catalyst comprises a Group VIII metal on a zeolitic support.

11. The process of claim 1, wherein the dimerization catalyst is an acidic ionic liquid.

12. The process of claim 1, wherein the dimerization catalyst is nickel ZSM-5.

13. The process of claim 1, wherein at least a portion of the light fraction is recycled to a dehydrogenation zone to form additional olefins.

14. The process of claim 1, wherein the heavy fraction is hydrofinished.

15. The process of claim 1, wherein the heavy product have a viscosity of greater than 2 cSt at 100° C., a viscosity index of at least 80, and a pour point of less than −10° C.

16. The process of claim 1, wherein the heavy fraction has a viscosity of greater than 2 cSt at 100° C., a viscosity index of at least 120, and a pour point of less than −20° C.

17. The process of claim 1, wherein the heavy product fraction is predominately a bright stock fraction having a viscosity of greater than 180 cSt at 40° C.

18. The process of claim 1, wherein the light fraction of step c) includes unreacted paraffins.

19. The process of claim 1, wherein the second dimerization zone is within a catalytic distillation unit, and wherein the second product is separated within the catalytic distillation unit into the light fraction and the heavy fraction.

20. The process of claim 19, wherein a portion of the light fraction is refluxed to the catalytic distillation unit.

21. A process for making a lube base stock comprising:

a) separating a highly paraffinic feedstock into a light gas fraction, a naphtha fraction, and a wax fraction, b) dehydrogenating the naphtha fraction in a dehydrogenation zone to produce an olefinic feedstock, c) contacting the olefinic feedstock with a dimerization catalyst in a first dimerization zone to produce a first product, d) contacting the first product with a dimerization catalyst in a second dimerization zone to produce a second product, e) hydrofinishing the wax fraction and the second product, wherein skeletal isomerization is induced to produce an isomerized product, f) separating the isomerized product into a light fraction and a heavy fraction, wherein the heavy product fraction comprises a lube base stock, and g) recycling substantially all of said light fraction to said dehydrogenation zone.

22. The process of claim 21, wherein the highly paraffinic feedstock is produced, in whole or in part, by Fischer-Tropsch synthesis.

* * * * *